US010501263B2

(12) United States Patent
Kraeling

(10) Patent No.: US 10,501,263 B2
(45) Date of Patent: Dec. 10, 2019

(54) SHIPPING CONTAINER WITH HINGED, SLIDING DUNNAGE

(71) Applicant: ORBIS Corporation, Oconomowoc, WI (US)

(72) Inventor: Brett Kraeling, Greenville, SC (US)

(73) Assignee: ORBIS Corporation, Oconomowoc, WI (US)

( * ) Notice: Subject to any disclaimer, the term of this patent is extended or adjusted under 35 U.S.C. 154(b) by 90 days.

(21) Appl. No.: 15/624,960

(22) Filed: Jun. 16, 2017

(65) Prior Publication Data

US 2017/0362022 A1 Dec. 21, 2017

Related U.S. Application Data

(60) Provisional application No. 62/351,409, filed on Jun. 17, 2016.

(51) Int. Cl.

| | |
|---|---|
| ***B65D 88/54*** | (2006.01) |
| ***B65D 85/68*** | (2006.01) |
| ***B65D 88/12*** | (2006.01) |
| ***A47F 5/12*** | (2006.01) |
| ***B65D 25/00*** | (2006.01) |
| ***A47B 46/00*** | (2006.01) |
| ***A47F 5/00*** | (2006.01) |
| ***A47F 3/06*** | (2006.01) |

(52) U.S. Cl.

CPC ..... *B65D 88/546* (2013.01); *A47B 46/005* (2013.01); *A47F 3/063* (2013.01); *A47F 5/0037* (2013.01); *A47F 5/12* (2013.01); *B65D 25/005* (2013.01); *B65D 85/68* (2013.01); *B65D 88/12* (2013.01); *B65D 2585/6887* (2013.01)

(58) Field of Classification Search

CPC ..... B65D 88/546; B65D 88/12; B65D 85/68; B65D 2585/6887; B65D 25/005; A47B 46/00; A47B 46/005; A47B 57/04; A47F 5/0037; A47F 5/12; A47F 5/0025; A47F 5/0018; A47F 3/063

USPC ..... 220/558, 479; 206/738; 211/134, 135, 211/150, 153

See application file for complete search history.

(56) References Cited

U.S. PATENT DOCUMENTS

| | | | | |
|---|---|---|---|---|
| 4,030,600 | A | 6/1977 | Hemps | |
| 5,137,340 | A * | 8/1992 | Cugley | A47B 67/04 312/107 |
| 5,560,507 | A | 10/1996 | Arpin et al. | |
| 9,676,548 | B2 | 6/2017 | Bradford et al. | |
| 2007/0000853 | A1 * | 1/2007 | Gerstner | A47F 5/0025 211/71.01 |
| 2017/0036807 | A1 | 2/2017 | Bos et al. | |

* cited by examiner

*Primary Examiner* — Andrew D Perreault

(74) *Attorney, Agent, or Firm* — Greensfelder, Hemker & Gale, P.C.

(57) ABSTRACT

A shipping container includes a body defining an interior. The shipping container further includes a dunnage assembly, the dunnage assembly including a tray and a hinge, the hinge subdividing the tray into a first tray portion and a second tray portion. The dunnage assembly is movable along a transverse axis between a first position wherein the second tray portion is at least partially disposed within the interior and a second position wherein the second tray portion is entirely exterior to the body. The second tray portion is rotatable relative to the first tray portion about the hinge when the dunnage assembly is moved between the first position and the second position.

18 Claims, 5 Drawing Sheets

SHIPPING CONTAINER WITH HINGED, SLIDING DUNNAGE

PRIORITY CLAIM

This application claims priority to U.S. Provisional Patent Application Ser. No. 62/351,409 filed Jun. 17, 2016 and entitled "SHIPPING CONTAINER WITH HINGED, SLIDING DUNNAGE", and which is incorporated by reference in its entirety herein.

FIELD OF THE INVENTION

The present disclosure relates generally to shipping containers, and more particularly to shipping containers which include improved dunnage assemblies for facilitating ease of access to components being shipped in the shipping containers.

BACKGROUND OF THE INVENTION

Shipping containers are utilized in a variety of industries, such as for shipping components to manufacturers or for downstream assembly. One particular industry in which shipping containers are utilized is the automotive industries. Components such as car door, panels, etc. can be loaded into protective containers for shipping, and shipped to the next company in the supply chain for manufacture of the automobile.

One issue with known shipping containers is accessibility to the components contained within the shipping container. For example, once a shipping container is received at a destination, it may be relatively difficult to access each individual component in the shipping container for unloading thereof. Improved shipping containers are thus desired in the art.

BRIEF DESCRIPTION OF THE INVENTION

Aspects and advantages of the invention will be set forth in part in the following description, or may be obvious from the description, or may be learned through practice of the invention.

In accordance with one embodiment, a shipping container is provided. The shipping container includes a body defining an interior, the body including a top wall, a bottom wall, a right sidewall, a left sidewall, and a rear wall, the bottom wall spaced from the top wall along a vertical axis, the right sidewall and left sidewall each extending between the top wall and the bottom wall, the left sidewall spaced from the right sidewall along a longitudinal axis. The body further defines a front opening, the front opening spaced from the rear wall along a transverse axis. The shipping container further includes a dunnage assembly, the dunnage assembly including a tray and a hinge, the hinge subdividing the tray into a first tray portion and a second tray portion. The dunnage assembly is movable along the transverse axis between a first position wherein the second tray portion is at least partially disposed within the interior and a second position wherein the second tray portion is entirely exterior to the body. The second tray portion is rotatable relative to the first tray portion about the hinge when the dunnage assembly is moved between the first position and the second position.

In accordance with another embodiment, a shipping container is provided. The shipping container includes a body defining an interior, the body including a top wall, a bottom wall, a right sidewall, a left sidewall, and a rear wall, the bottom wall spaced from the top wall along a vertical axis, the right sidewall and left sidewall each extending between the top wall and the bottom wall, the left sidewall spaced from the right sidewall along a longitudinal axis. The body further defines a front opening, the front opening spaced from the rear wall along a transverse axis. The shipping container further includes a dunnage assembly, the dunnage assembly including a tray and a hinge, the hinge extending along the longitudinal axis and subdividing the tray into a first tray portion and a second tray portion. The dunnage assembly is movable along the transverse axis between a first position wherein the second tray portion is at least partially disposed within the interior and a second position wherein the second tray portion is entirely exterior to the body. The second tray portion and first tray portion are coplanar when the dunnage assembly is in the first position. The second tray portion is rotatable relative to the first tray portion about the hinge when the dunnage assembly is moved between the first position and the second position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
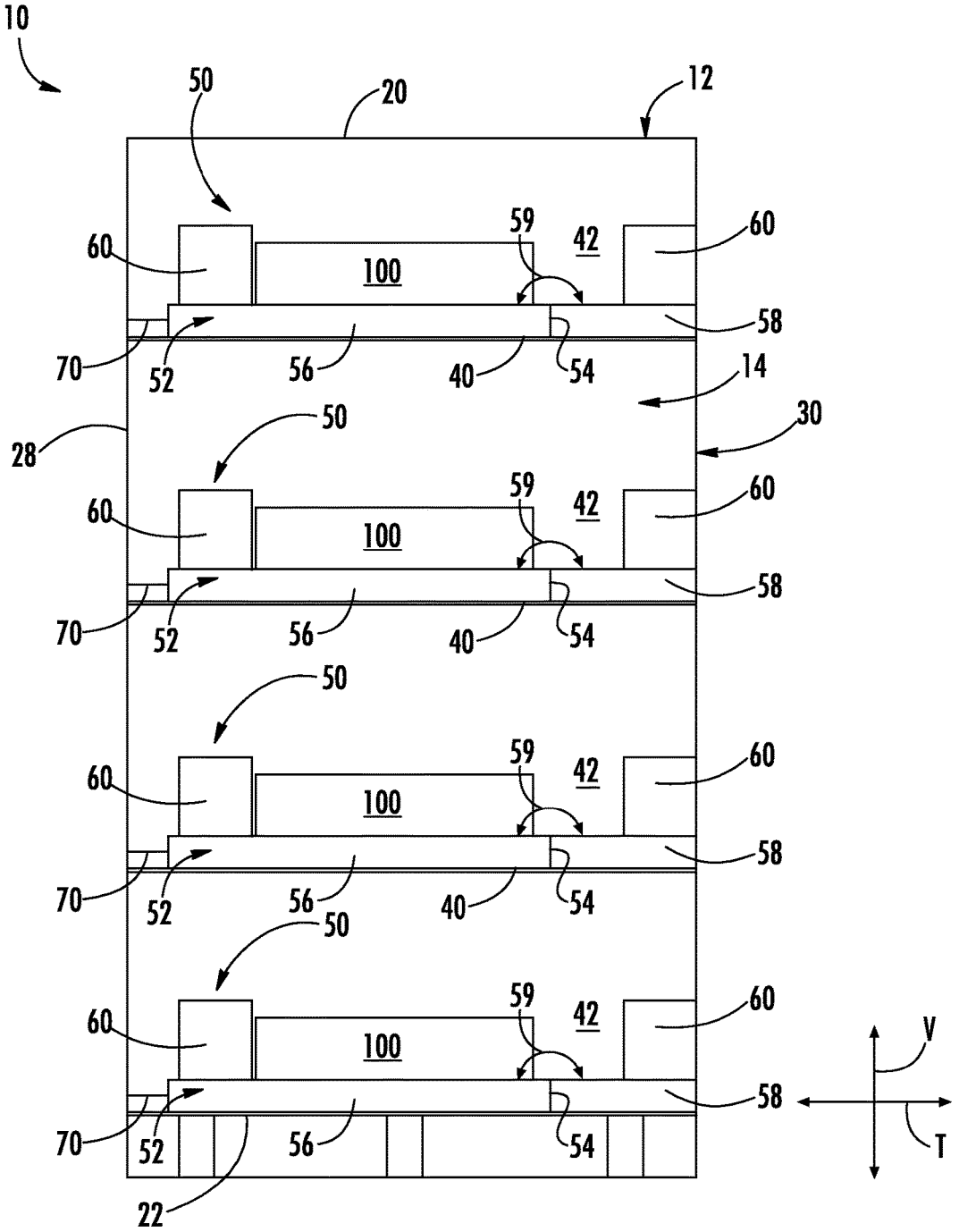
FIG. 1 is a side sectional view of a shipping container with a dunnage assembly in a first position in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present disclosure is directed to shipping containers having movable dunnage assemblies. Each dunnage assembly generally holds a component for shipping in the shipping container. Further, each dunnage assembly advantageously includes features for facilitating easy and efficient access to such components for removal of the components at a destination (or initial loading of the components into the dunnage assemblies and shipping container generally).

Referring now to FIGS. 1 through 4, embodiments of a shipping container 10 in accordance with the present disclosure are provided. Shipping container 10 includes a body 12 which defines an interior 14. The body 12 may, for example, include a top wall 20 and bottom wall 22. The body 12 may further include, for example, a right sidewall 24 and a left sidewall 26. The body 12 may further include, for example, a rear wall 28. Additionally, the body may define a front opening 30 through which the interior 14 is accessible. The bottom wall 22 may be spaced apart from the top wall 20 along a vertical axis V, and may thus be below the top wall 20 along the vertical axis V. The sidewalls 24, 26 may each extend between the top wall 20 and bottom wall 22. The left sidewall 26 may be spaced apart from the right sidewall 24 along a longitudinal axis L. The front opening 30 may be spaced from the rear wall 28 along a transverse axis T. As shown, body 12 in exemplary embodiments may have a generally cubic shape.

Notably, the vertical axis V, longitudinal axis L, and transverse axis T may be mutually orthogonal, thus defining a coordinate system.

In some embodiments, shipping container 10 may further include one or more panels 40. The panels 40 may be disposed within the interior 14, and may divide the interior 14 into a plurality of pockets 42. Further, various of the panels 40 may have varying orientations within the interior 14. For example, one or more panels may extend between the left and right sidewalls 24, 26, and may further oriented generally within a longitudinal axis L-transverse axis T plane. Additionally or alternatively, one or more panels may extend between the top and bottom walls 20, 22, and may further oriented generally within a vertical axis L-transverse axis T plane. Additionally or alternatively, other suitable orientations may be utilized.

Referring now to FIGS. 1 through 5, one or more dunnage assemblies 50 may be positioned in the interior 14. Each dunnage assembly 50 may support a component 100 within the shipping container 10 during transportation of the shipping container 10. In embodiments wherein the interior 14 is divided into a plurality of pockets 42, a dunnage assembly 50 may be positioned in a pocket 42.

A dunnage assembly 50 in accordance with the present disclosure includes a tray 52 and a hinge 54. The tray 52 is a base support component for the dunnage assembly 50, on which other components of the dunnage assembly 50 and components 100 to be shipped are provided. Hinge 54 may subdivide the tray 52 into two separate pieces, a first tray portion 56 and a second tray portion 58, which are rotatably connected to each other by the hinge 54. Accordingly, the second tray portion 58 may be rotatable relative to the first tray portion 56 about the hinge 54 (and thus via the hinge 54), as discussed herein.

In exemplary embodiments, the hinge 54 of a dunnage assembly 50 is oriented to extend along the longitudinal axis L when the dunnage assembly 50 is positioned in the shipping container 10. Alternatively, however, the hinge 54 may be oriented to extend along the vertical axis V or the transverse axis T, or at any other suitable angle to the vertical axis V, transverse axis T, and/or longitudinal axis L.

In exemplary embodiments as shown, a dunnage assembly 50 may further include one or more support members 60. Such support members 60 may be mounted on the tray 52 (such as via a suitable adhesive or mechanical fastener) for supporting components 100 to be shipped. For example, one or more support members 60 may be mounted on the first tray portion 56 and/or the second tray portion 58. Support members 60 may be formed from foam or other suitable materials for supporting components 100 to be shipped.

Dunnage assembly 50 may be movable relative to the shipping container 10 to facilitate loading and unloading of components 100 therefrom. For example, as illustrated, a dunnage assembly 50 may be movable along the transverse axis T between a first position (see FIGS. 1 and 3) and a second position (see FIGS. 2 and 4). In the first position, the dunnage assembly 50 may be at least partially disposed within the interior 14, such as in exemplary embodiments entirely disposed within the interior 14. More specifically, in the first position, the second tray portion 58 may be at least partially disposed within the interior 14, such as in exemplary embodiments entirely disposed within the interior 14. The first tray portion 56 may, as shown, be at least partially or entirely disposed within the interior 14 in the second position.

Further, in exemplary embodiments as shown, the second tray portion 58 and first tray portion 56 may be coplanar (such as both oriented in a longitudinal axis L-transverse axis T plane or other suitable plane) when the dunnage assembly 50 is in the first position. In the second position, the dunnage assembly 50 may be at least partially disposed exterior to the body 12 (and interior 14 thereof). More specifically, in the second position, the second tray portion 58 may be entirely exterior to the body 12 (and interior 14 thereof). The first tray portion 56 may be entirely disposed within the interior 14, partially disposed within the interior 14 and partially exterior to the body 12, or entirely exterior to the body 12 in the second position.

As shown, the second tray portion 58 is rotatable relative to the first tray portion 56 about the hinge 54 when the dunnage assembly 50 is moved between the first position and the second position. Accordingly, an angle 59 between the first tray portion 56 and second tray portion 58 in the second position may be different from the angle 59 in the first position (which in some exemplary embodiments may be 180 degrees, such as between 170 and 190 degrees). Such angle 59 may be defined perpendicularly to the hinge 54, as shown. For example, in the second position, the second tray portion 58 may be non-coplanar with the first tray portion 56.

As discussed, in exemplary embodiments, the hinge 54 extends along the longitudinal axis L. Accordingly, in these embodiments, the second tray portion 58 may be rotatable relative to the first tray portion 56 about the longitudinal axis L. Further, in exemplary embodiments, as shown, the second tray portion 58 may rotate relative to the first tray portion 56 when moved from the first position to the second position due to the force of gravity.

Such movement of the second tray portion 58 relative to the first tray portion 56 may advantageously facilitate, when the dunnage assembly 50 is in the second position, the addition or removal of a component 100 onto the dunnage assembly 50. In particular, the second tray portion 54 in the second position may provide increased access to the dunnage assembly 50 generally and any component 100 provided or being provided thereon. Further, the second tray portion 54 in the first position may restrict or block such access, thus protecting such component 100 for shipping.

Figure 2:
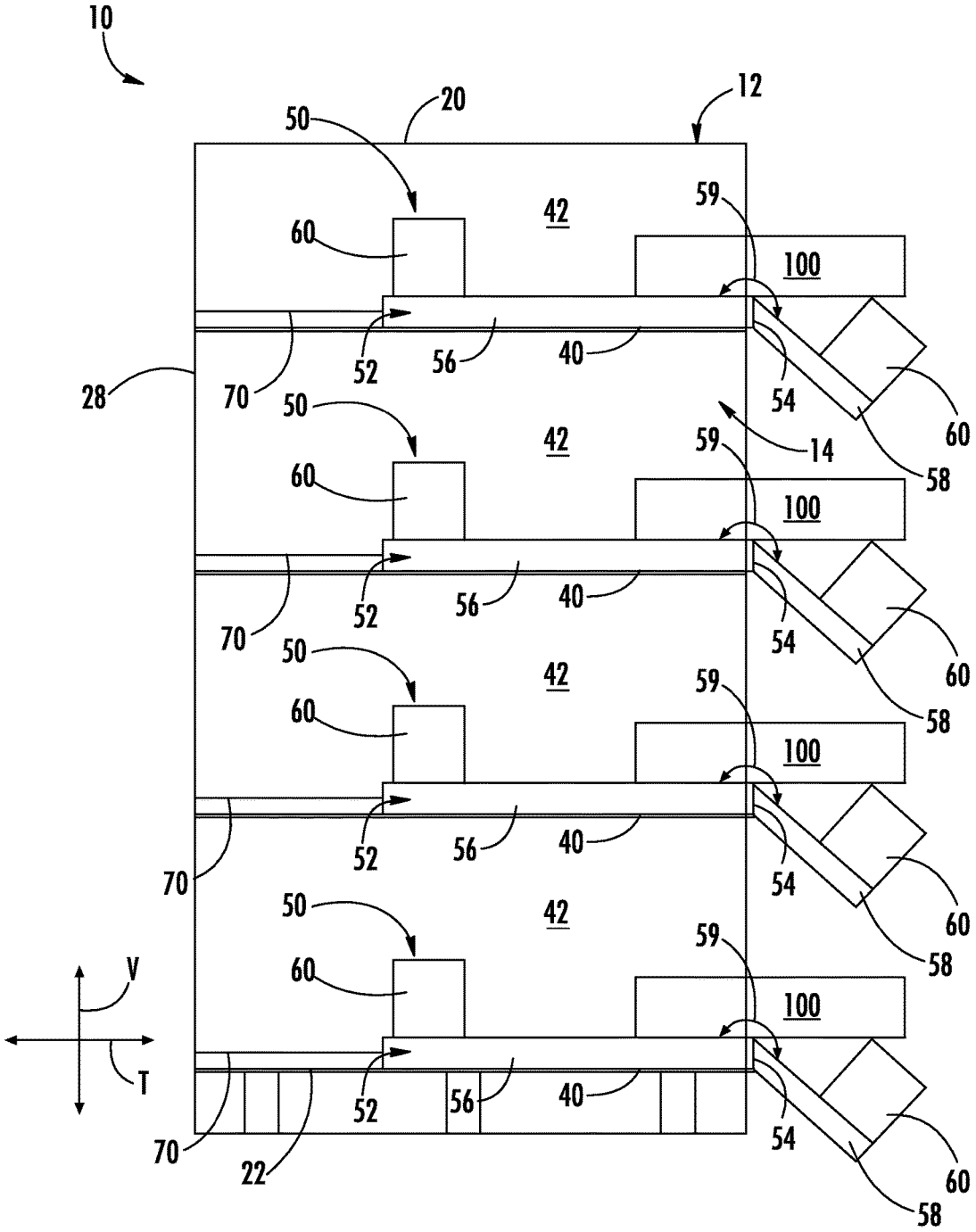
FIG. 2 is a side sectional view of a shipping container with a dunnage assembly in a second position in accordance with embodiments of the present disclosure.
Figure 3:
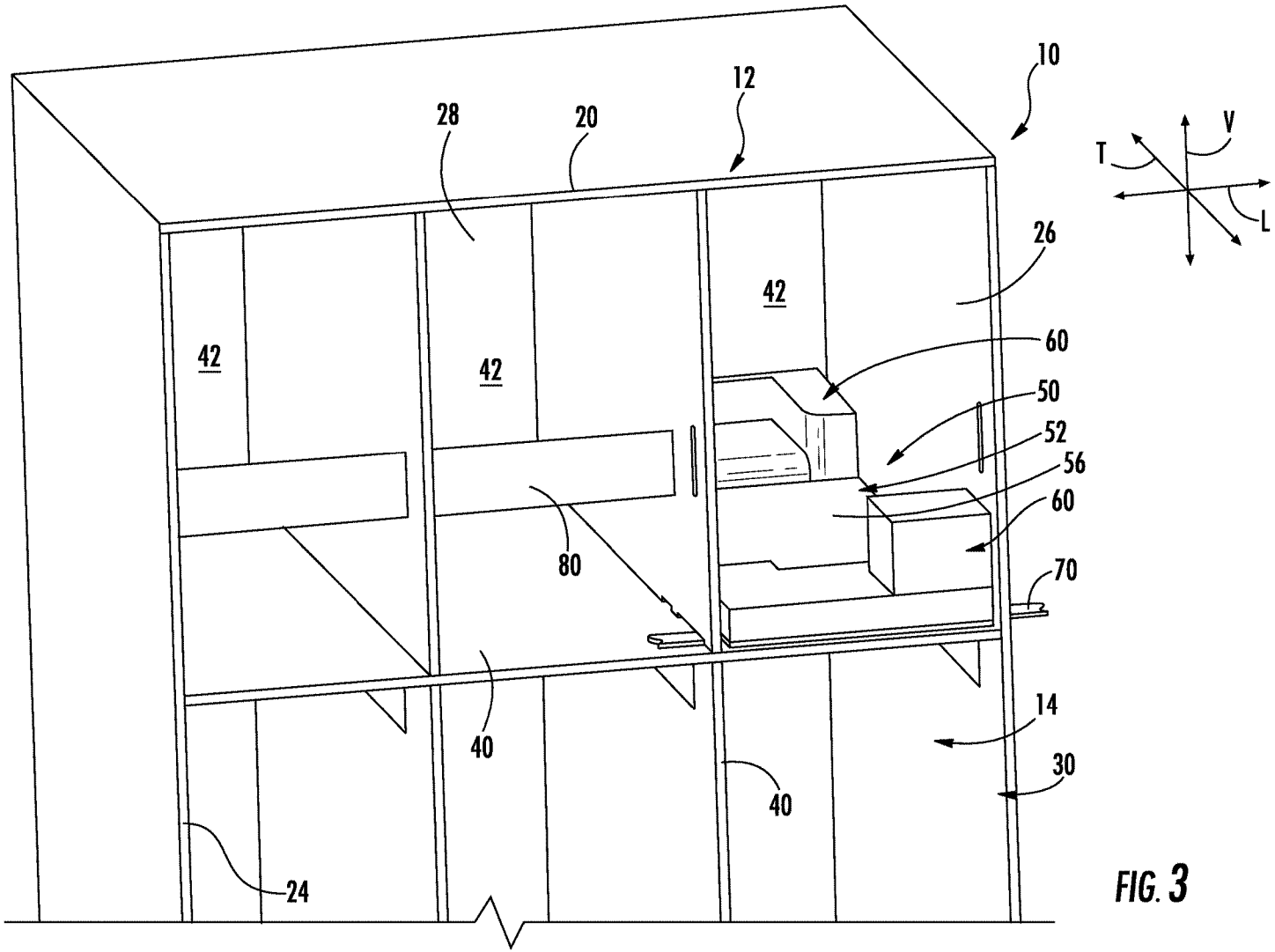
FIG. 3 is a front perspective view of a shipping container with a dunnage assembly in a first position in accordance with embodiments of the present disclosure.
Figure 4:
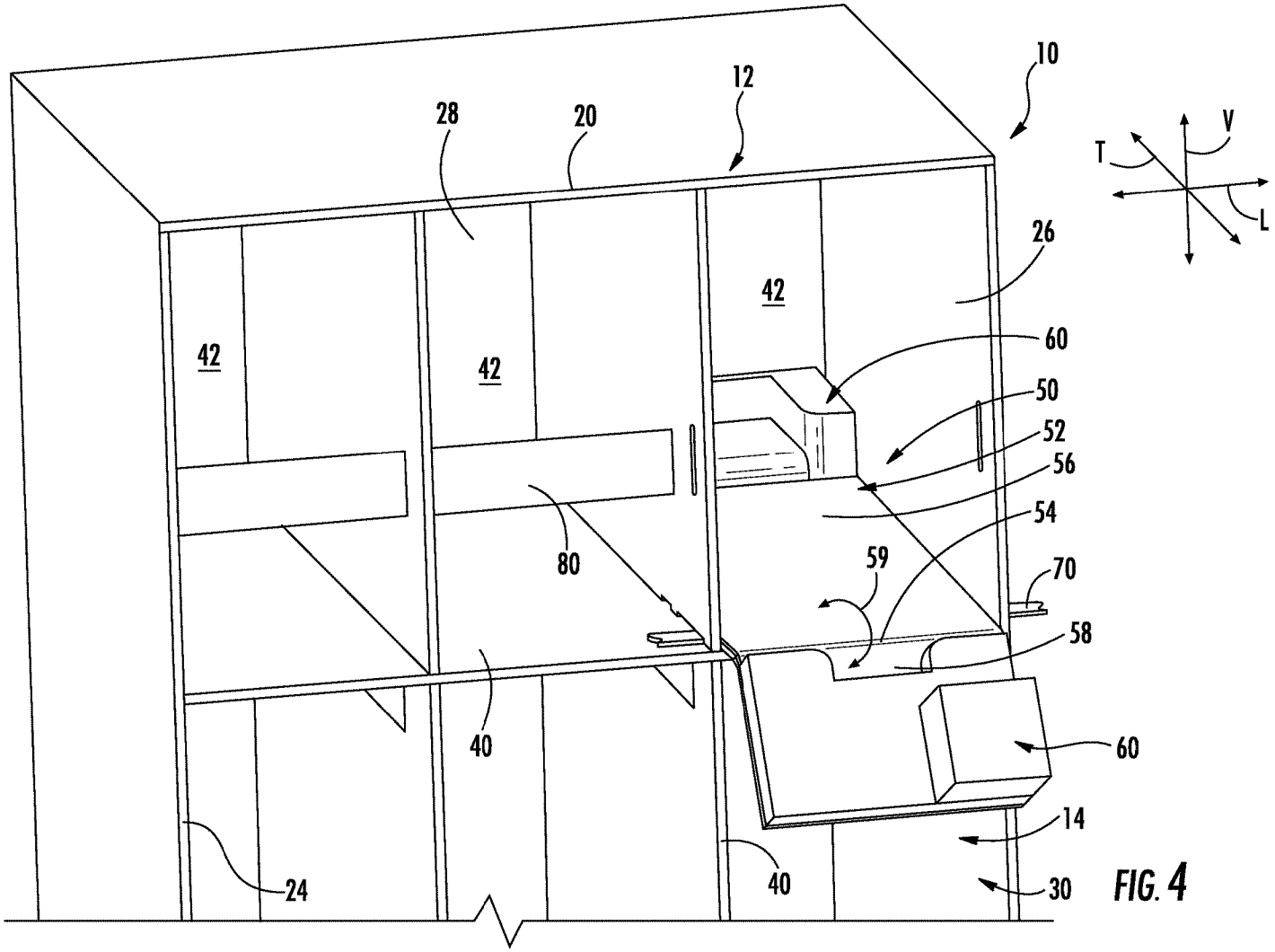
FIG. 4 is a front perspective view of a shipping container with a dunnage assembly in a second position in accordance with embodiments of the present disclosure.
Figure 5:
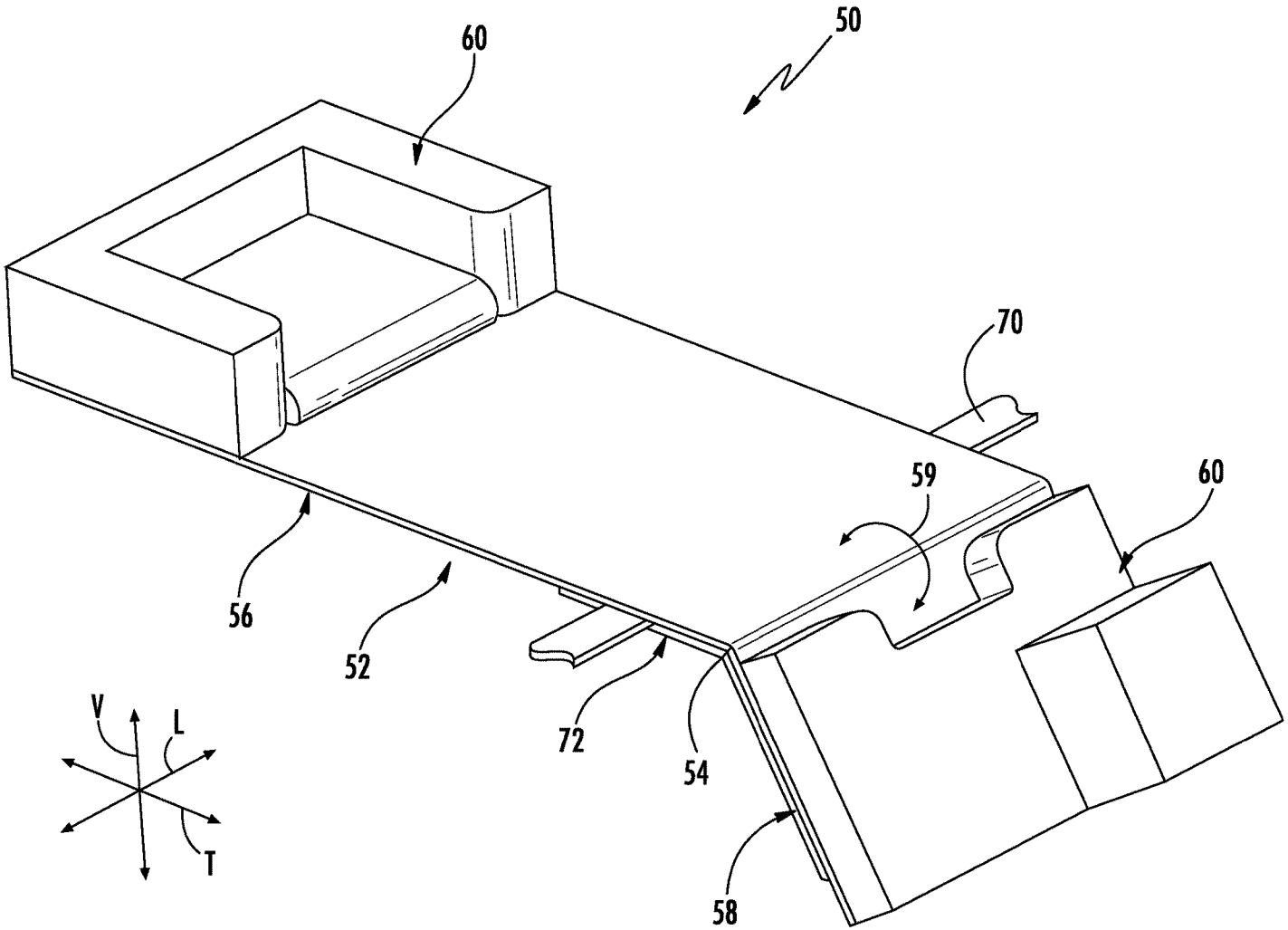
FIG. 5 is a perspective view of a dunnage assembly in a second position in accordance with embodiments of the present disclosure.

In exemplary embodiments, a strap 70 may limit movement of the dunnage assembly 50 along the transverse axis T. For example, the strap 70 may prevent movement of the dunnage assembly 50 such that the first tray portion 54 is entirely exterior to the body 12. As shown, strap 70 may connect the dunnage assembly 50 and the body 12. For example, in some embodiments, as illustrated in FIGS. 1 and 2, the strap 70 may extend along the transverse axis T, such as between the dunnage assembly 50 and the rear wall 28. Accordingly, such strap 70 connects the dunnage assembly 50 and rear wall 28, such that movement of the dunnage assembly 50 away from the rear wall 28 is limited by the length of the strap 70. In other embodiments, as illustrated in FIGS. 3 through 5, the strap 70 may extend through the dunnage assembly 50, such as along the longitudinal axis L as shown. For example, a slot 72 may be defined in the dunnage assembly 50, such as through or partially by the first tray portion 54. Movement of the dunnage assembly 50 away from and towards the rear wall 28 may be limited by the interaction of the strap 70 with the slot 72, and in particular by the size of the slot 72 along the transverse direction T.

In exemplary embodiments as illustrated, one or more shipping bands 80 may additionally be provided in shipping container 10. A shipping band 80 may extend through a portion of the interior 14, such as along the longitudinal axis 14 as shown, when installed in the shipping container 10. Such shipping band 80 when installed may prevent movement of a dunnage assembly 50 from a first position to a second position. Such shipping band 80 may, for example, be installed after loading of a component 100 into a dunnage assembly 50 and when the dunnage assembly 50 is in the first position. When shipping is completed, such shipping band 80 may be removed to allow the dunnage assembly 50 move from the first position to the second position, for easy and efficient removal of the component 100 therefrom.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A shipping container, comprising:

a body defining an interior, the body comprising a top wall, a bottom wall, a right sidewall, a left sidewall, and a rear wall, the bottom wall spaced from the top wall along a vertical axis, the right sidewall and left sidewall each extending between the top wall and the bottom wall, the left sidewall spaced from the right sidewall along a longitudinal axis, the body further defining a front opening, the front opening spaced from the rear wall along a transverse axis;

a dunnage assembly, the dunnage assembly comprising a tray forming a base support for the dunnage assembly and a hinge in the base support, the hinge subdividing the tray into a first tray portion having a first portion of the base support and a second tray portion having a second portion of the base support, the first tray portion including a first support member extending upward and the second tray including a second support member extending upward, the dunnage assembly movable along the transverse axis between a first position wherein the second tray portion is at least partially disposed within the interior and a second position wherein the second tray portion is entirely exterior to the body, and wherein the second tray portion is rotatable relative to the first tray portion about the hinge when the dunnage assembly is moved between the first position and the second position; and a strap connecting the dunnage assembly and the body, the dunnage assembly having a slot receiving the strap.

2. The shipping container of claim 1, wherein the second tray portion is entirely disposed within the interior when the dunnage assembly is in the first position.

3. The shipping container of claim 1, wherein the second tray portion and first tray portion are coplanar when the dunnage assembly is in the first position.

4. The shipping container of claim 1, wherein the hinge extends along the longitudinal axis.

5. The shipping container of claim 1, wherein the strap limits movement of the dunnage assembly along the transverse axis.

6. The shipping container of claim 5, wherein the strap extends along the transverse axis between the dunnage assembly and the rear wall.

7. The shipping container of claim 5, wherein the strap extends along the longitudinal axis through the dunnage assembly.

8. The shipping container of claim 1, wherein the first support member is formed from foam.

9. The shipping container of claim 1, further comprising at least one panel disposed within the interior and dividing the interior into a plurality of pockets, and wherein the dunnage assembly is positioned in one of the plurality of pockets.

10. The shipping container of claim 9, wherein the at least one panel is a plurality of panels.

11. A shipping container, comprising:

a body defining an interior, the body comprising a top wall, a bottom wall, a right sidewall, a left sidewall, and a rear wall, the bottom wall spaced from the top wall along a vertical axis, the right sidewall and left sidewall each extending between the top wall and the bottom wall, the left sidewall spaced from the right sidewall along a longitudinal axis, the body further defining a front opening, the front opening spaced from the rear wall along a transverse axis;

a dunnage assembly, the dunnage assembly comprising a tray forming a base support for the dunnage assembly and a hinge in the base support, the hinge extending along the longitudinal axis and subdividing the tray into a first tray portion having a first portion of the base support and a second tray portion having a second portion of the base support, the first tray portion including a first support member mounted to the first tray portion and the second tray including a second support member mounted to the second tray portion, the dunnage assembly movable along the transverse axis between a first position wherein the second tray portion is at least partially disposed within the interior and a second position wherein the second tray portion is entirely exterior to the body, wherein the second tray portion and first tray portion are coplanar when the dunnage assembly is in the first position, and wherein the second tray portion is rotatable relative to the first tray portion about the hinge when the dunnage assembly is moved between the first position and the second position; and a strap connecting the dunnage assembly and the body, the dunnage assembly having a slot receiving the strap.

12. The shipping container of claim 11, wherein the second tray portion is entirely disposed within the interior when the dunnage assembly is in the first position.

13. The shipping container of claim 11, wherein the strap limits movement of the dunnage assembly along the transverse axis.

14. The shipping container of claim 13, wherein the strap extends along the transverse axis between the dunnage assembly and the rear wall.

15. The shipping container of claim 13, wherein the strap extends along the longitudinal axis through the dunnage assembly.

16. The shipping container of claim 11, wherein the first support member is formed from foam.

17. The shipping container of claim 11, further comprising at least one panel disposed within the interior and dividing the interior into a plurality of pockets, and wherein the dunnage assembly is positioned in one of the plurality of pockets.

18. The shipping container of claim 17, wherein the at least one panel is a plurality of panels.

* * * * *